US006892816B2

(12) United States Patent
Pringle et al.

(10) Patent No.: US 6,892,816 B2
(45) **Date of Patent: *May 17, 2005**

(54) METHOD AND APPARATUS FOR SELECTIVE INJECTION OR FLOW CONTROL WITH THROUGH-TUBING OPERATION CAPACITY

(75) Inventors: Ronald E. Pringle, Houston, TX (US); Arthur J. Morris, Magnolia, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/883,595

(22) Filed: Jun. 18, 2001

(65) Prior Publication Data

US 2001/0045290 A1 Nov. 29, 2001

Related U.S. Application Data

(63) Continuation-in-part of application No. 09/441,701, filed on Nov. 16, 1999, now Pat. No. 6,631,767.

(60) Provisional application No. 60/108,810, filed on Nov. 17, 1998.

(51) Int. Cl.[7] ..... E21B 3/10; E21B 43/14

(52) U.S. Cl. ..... 166/320; 166/321; 166/332.8; 166/313

(58) Field of Search ..... 166/321, 313, 166/50, 320, 324, 323, 332.4, 332.8

(56) References Cited

U.S. PATENT DOCUMENTS

| | | | | | |
|---|---|---|---|---|---|
| 2,090,180 | A | * | 8/1937 | Bryant | 166/236 |
| 2,419,313 | A | * | 4/1947 | Byrd | 166/143 |
| 2,681,111 | A | * | 6/1954 | Thompson | 166/235 |
| 3,095,041 | A | * | 6/1963 | Rasmussen | 166/235 |
| 3,105,553 | A | * | 10/1963 | Chisolm | 166/133 |
| 3,395,758 | A | * | 8/1968 | Kelly et al. | 166/100 |
| 3,662,826 | A | * | 5/1972 | Young et al. | 166/152 |
| 3,664,415 | A | * | 5/1972 | Wray et al. | 166/336 |
| 3,741,300 | A | * | 6/1973 | Wolff et al. | 166/184 |
| 3,814,181 | A | * | 6/1974 | Young | 166/324 |
| 4,043,392 | A | * | 8/1977 | Gazda | 166/217 |
| 4,134,454 | A | * | 1/1979 | Taylor | 166/320 |
| 4,201,364 | A | * | 5/1980 | Taylor | 251/175 |
| 4,253,522 | A | * | 3/1981 | Setterberg, Jr. | 166/278 |
| 4,354,554 | A | * | 10/1982 | Calhoun et al. | 166/321 |
| 4,440,221 | A | * | 4/1984 | Taylor et al. | 166/106 |
| 4,473,122 | A | * | 9/1984 | Tamplen | 166/373 |
| 4,858,690 | A | * | 8/1989 | Rebardi et al. | 166/278 |
| 4,928,772 | A | * | 5/1990 | Hopmann | 166/386 |
| 4,969,524 | A | * | 11/1990 | Whiteley | 166/278 |
| 5,183,114 | A | * | 2/1993 | Mashaw et al. | 166/319 |
| 5,211,241 | A | * | 5/1993 | Mashaw et al. | 166/320 |
| 5,295,538 | A | * | 3/1994 | Restarick | 166/205 |
| RE34,758 | E | * | 10/1994 | Farley et al. | 166/319 |
| 5,377,750 | A | * | 1/1995 | Arterbury et al. | 166/205 |
| 5,579,844 | A | * | 12/1996 | Rebardi et al. | 166/296 |
| 5,609,204 | A | * | 3/1997 | Rebardi et al. | 166/51 |
| 5,730,223 | A | * | 3/1998 | Restarick | 166/380 |
| 5,755,286 | A | * | 5/1998 | Ebinger | 166/281 |
| 5,803,179 | A | * | 9/1998 | Echols et al. | 166/370 |
| 5,865,251 | A | * | 2/1999 | Rebardi et al. | 166/278 |
| 5,957,207 | A | * | 9/1999 | Schnatzmeyer | 166/332.1 |
| 5,979,558 | A | * | 11/1999 | Bouldin et al. | 166/363 |
| 6,073,696 | A | * | 6/2000 | Ellis | 166/312 |
| 6,079,494 | A | * | 6/2000 | Longbottom et al. | 166/313 |
| 6,276,458 | B1 | * | 8/2001 | Malone et al. | 166/386 |
| 6,286,594 | B1 | * | 9/2001 | French | 166/151 |

FOREIGN PATENT DOCUMENTS

| | | | |
|---|---|---|---|
| GB | 1 077 562 | * | 8/1967 |
| WO | WO 96/10123 | * | 4/1996 |

* cited by examiner

*Primary Examiner*—Hoang Dang
(74) *Attorney, Agent, or Firm*—Robert Van Someren PC; Jaime Castaño; Brigitte Echols

(57) ABSTRACT

An in-line flow control device for a well chokes flow through a conduit while allowing access therethrough.

8 Claims, 17 Drawing Sheets

METHOD AND APPARATUS FOR SELECTIVE INJECTION OR FLOW CONTROL WITH THROUGH-TUBING OPERATION CAPACITY

RELATED APPLICATIONS

The present application is a continuation-in-part of U.S. patent application Ser. No. 09/441,701 filed Nov. 16, 1999 now U.S. Pat. No. 6,631,767 which claims priority to U.S. Provisional application No. 60/108,810 filed Nov. 17, 1998.

FIELD OF INVENTION

The present invention relates to subsurface well equipment and, more particularly, to a method and apparatus for remotely controlling injection or production fluids in well completions which may include gravel pack.

DESCRIPTION OF THE RELATED ART

As is well known to those skilled in the art, certain hydrocarbon producing formations include sand. Unless filtered out, such sand can become entrained or commingled with the hydrocarbons that are produced to the earth's surface. This is sometimes referred to as "producing sand", and can be undesirable for a number of reasons, including added production costs, and erosion of well tools within the completion, which could lead to the mechanical malfunctioning of such tools. Various approaches to combating this problem have been developed. For example, the industry has developed sand screens which are connected to the production tubing adjacent the producing formation to prevent sand from entering the production tubing. In those cases where sand screens alone will not sufficiently filter out the sand, the industry has learned that a very effective way of filtering sand from entry into the production tubing is to fill, or pack, the well annulus with gravel, hence the term "gravel pack" completions.

A drawback to gravel pack completions arises when it is desired to connect a remotely-controllable flow control device to the production tubing to regulate the flow of production fluids from the gravel-packed well annulus into the production tubing, or to regulate the flow of injection fluids from the production tubing into the gravel-packed well annulus. If the flow control device is of the type that includes a flow port in the sidewall of the body establishing fluid communication between the well annulus and the interior of the tool (such as the flow control device disclosed in U.S. Pat. No. 5,823,623), then the presence of gravel pack in the annulus adjacent the flow port may present an obstacle to the proper functioning of the flow control device, to the extent that the gravel pack may prohibit laminar flow through the flow port. As such, it is an object of the present invention to provide a flow control device that will enable the remote control of flow of production fluids and/or injection fluids in well completions where the annulus is packed with gravel. It is also an object of the present invention to provide such a tool that will enable the passage of wireline tools through the tool so that wireline intervention techniques may be performed at locations in the well below the flow control device.

SUMMARY OF THE INVENTION

An in-line flow control device for a well chokes flow through a conduit while allowing access therethrough.

BRIEF DESCRIPTION OF THE DRAWINGS

FIGS. 1A–1J taken together form a longitudinal sectional view of a specific embodiment of the flow control device of the present invention.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

For the purposes of this description, the terms "upper" and "lower," "up hole" and "downhole" and "upwardly" and "downwardly" are relative terms to indicate position and direction of movement in easily recognized terms. Usually, these terms are relative to a line drawn from an upmost position at the earth's surface to a point at the center of the earth, and would be appropriate for use in relatively straight, vertical wellbores. However, when the wellbore is highly deviated, such as from about 60 degrees from vertical, or horizontal, these terms do not make sense and therefore should not be taken as limitations. These terms are only used for ease of understanding as an indication of what the position or movement would be if taken within a vertical wellbore.

Figure 1A:
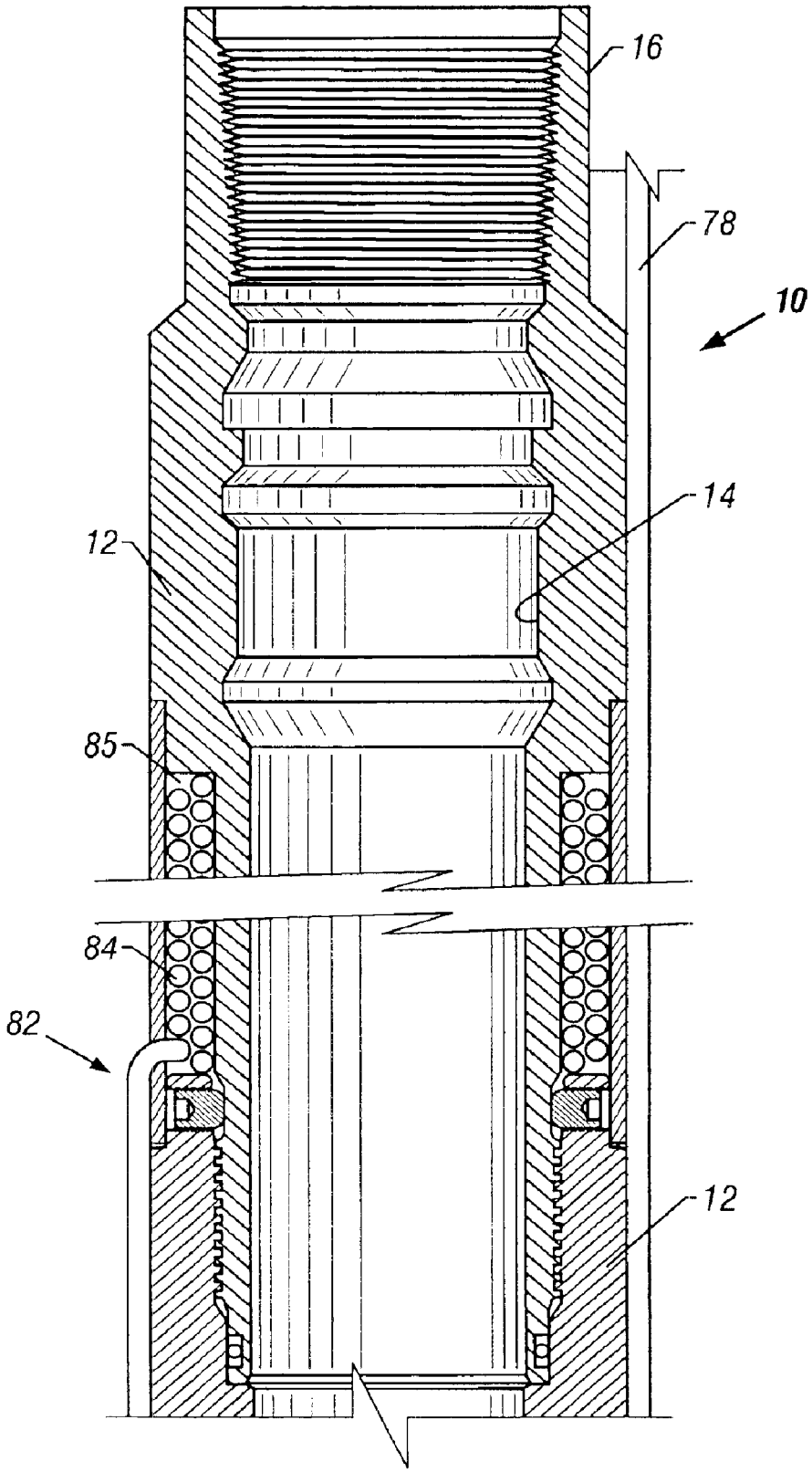
Figure 1B:
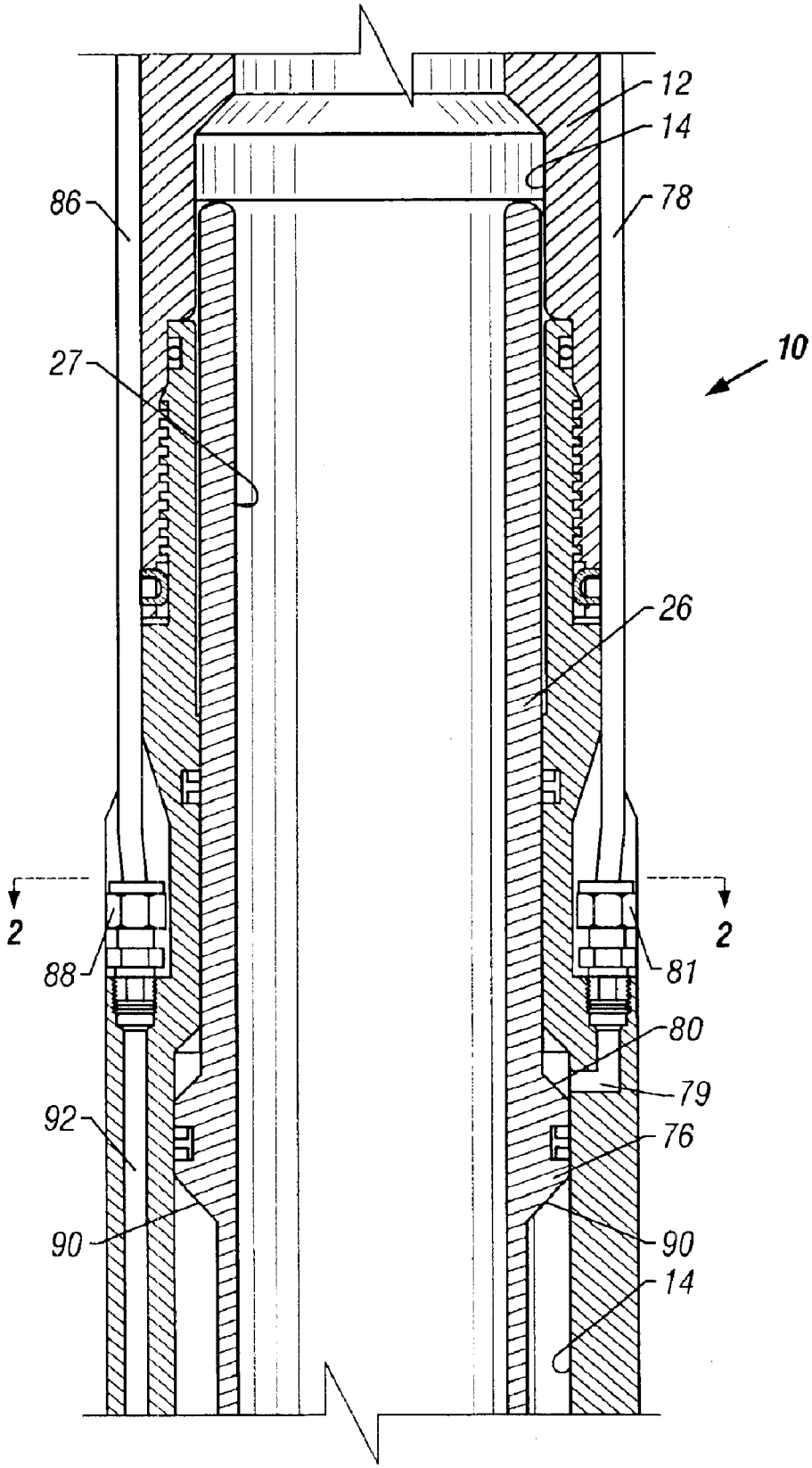
Figure 1C:
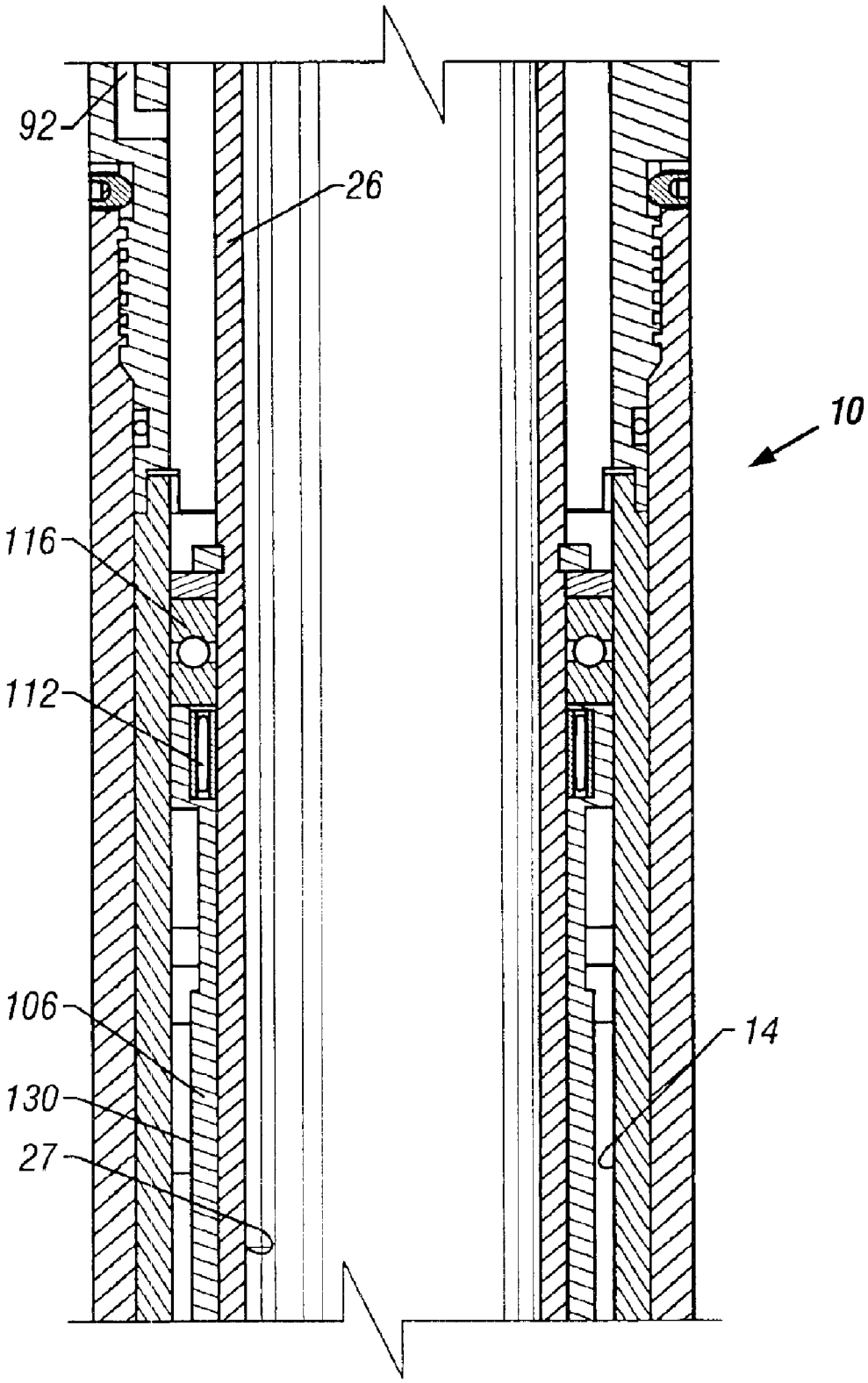
Figure 1D:
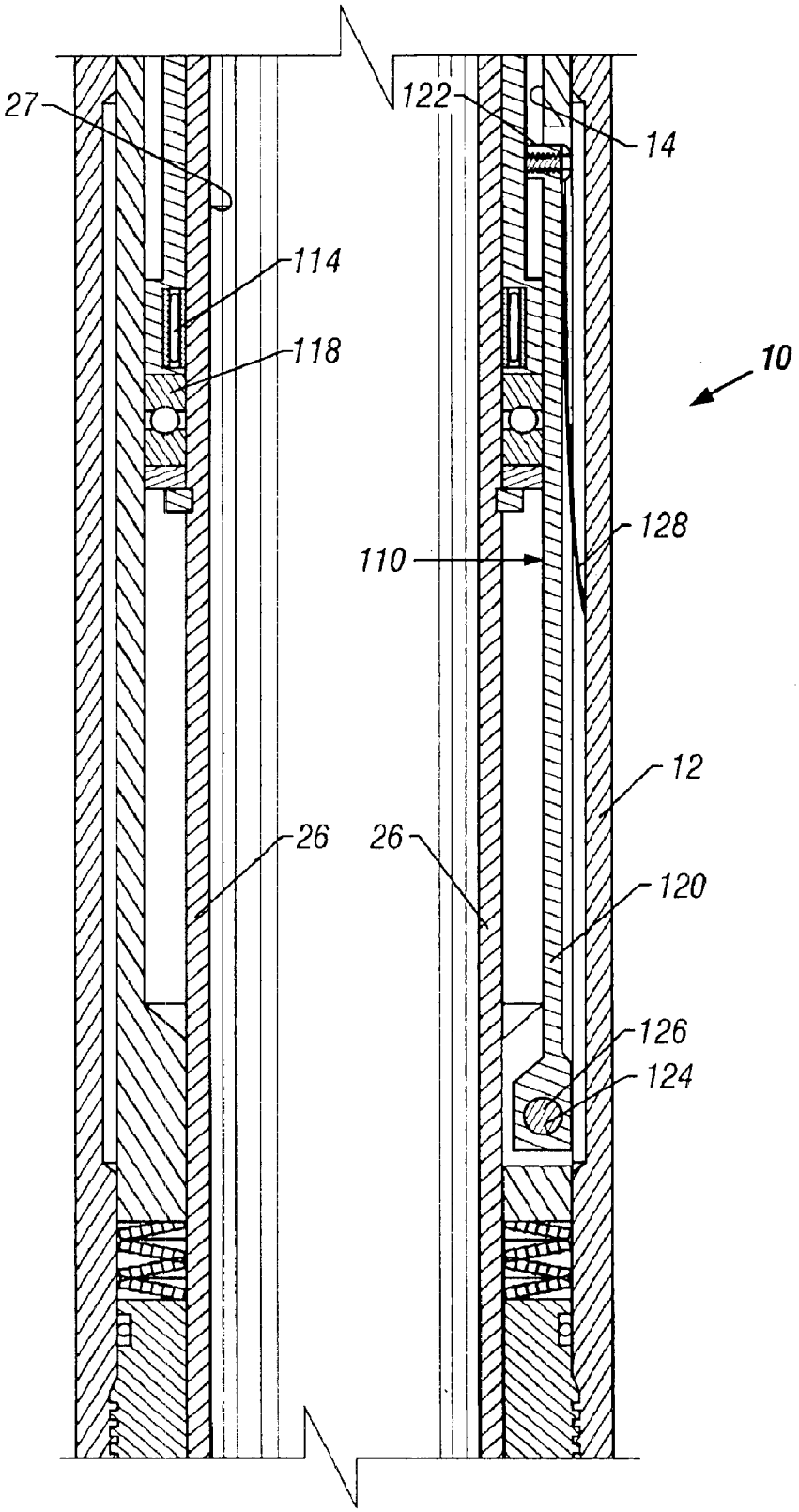
Figure 1E:
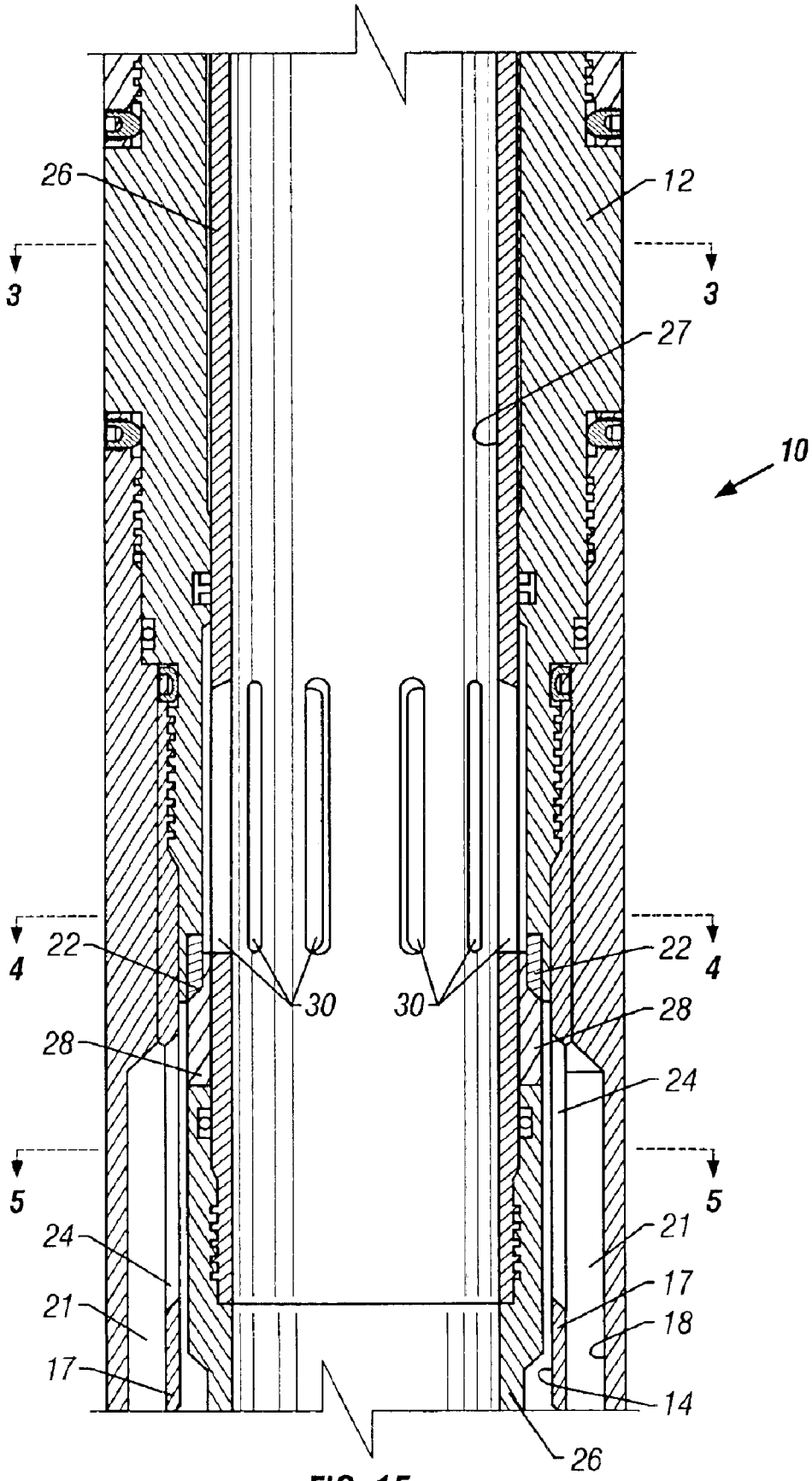

Referring to the drawings in detail, wherein like numerals denote identical elements throughout the several views, a specific embodiment of the downhole flow control device of the present invention is referred to generally by the numeral 10. Referring initially to FIG. 1A, the device 10 may include a generally cylindrical body member 12 having a first bore (or first passageway) 14 extending from a first end 16 of the body member 12 and through a generally cylindrical extension member 17 (FIGS. 1E–1I) disposed within the body member 12, and a second bore (or second passageway) 18 extending from a second end 20 of the body member 12 and into an annular space 21 disposed about the extension member 17. In a specific embodiment, the diameter of the second bore 18 is greater than the diameter of the first bore 14. As shown in FIG. 1E, the body member 12 may also include a first valve seat 22 disposed within the first bore 14, and the extension member 17 may include at least one flow port 24 establishing fluid communication between the annular space 21 and the first bore 14.

With reference to FIGS. 1B–1F, the device 10 may further include a first generally cylindrical sleeve member 26 movably disposed and remotely shiftable within the first bore 14. The manner in which the first sleeve member 26 is shifted within the first bore 14 will be described below. Referring to FIG. 1E, the first sleeve member 26 may include a second valve seat 28 adapted for cooperable sealing engagement with the first valve seat 22 to regulate fluid flow through the at least one flow port 24. The first sleeve member 26 may also include at least one flow slot 30.

Figure 1F:
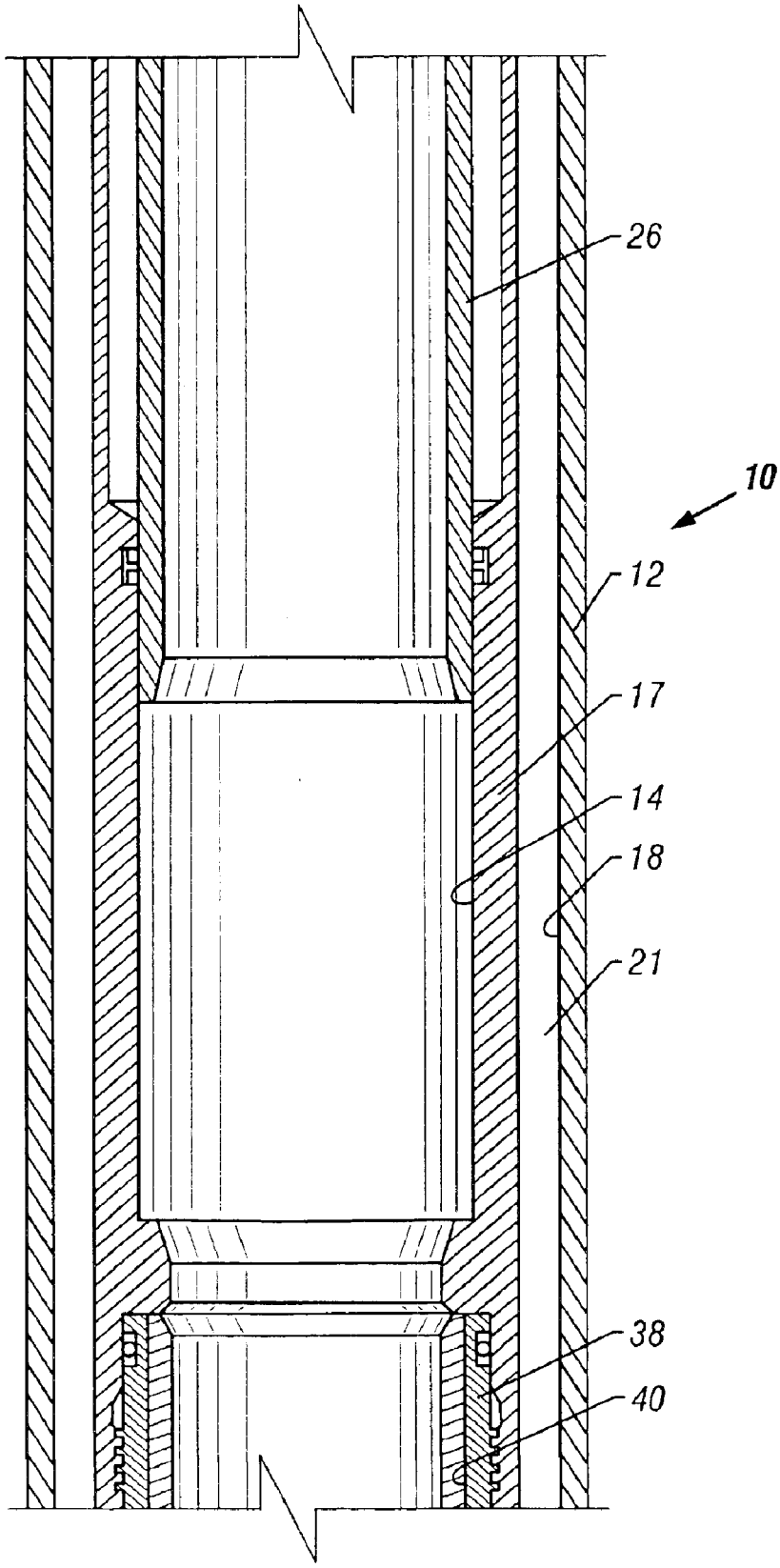
Figure 1G:
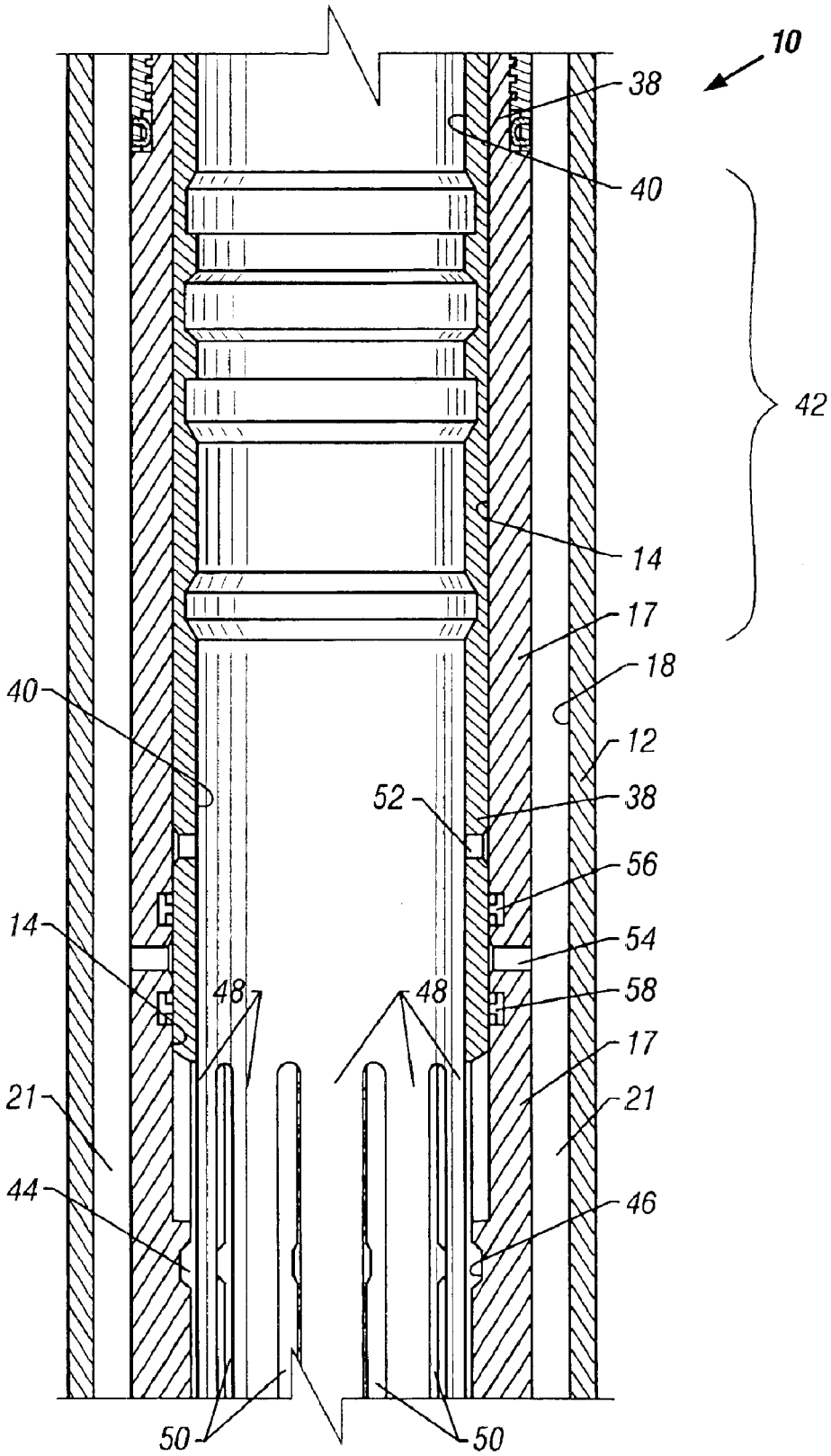
Figure 1H:
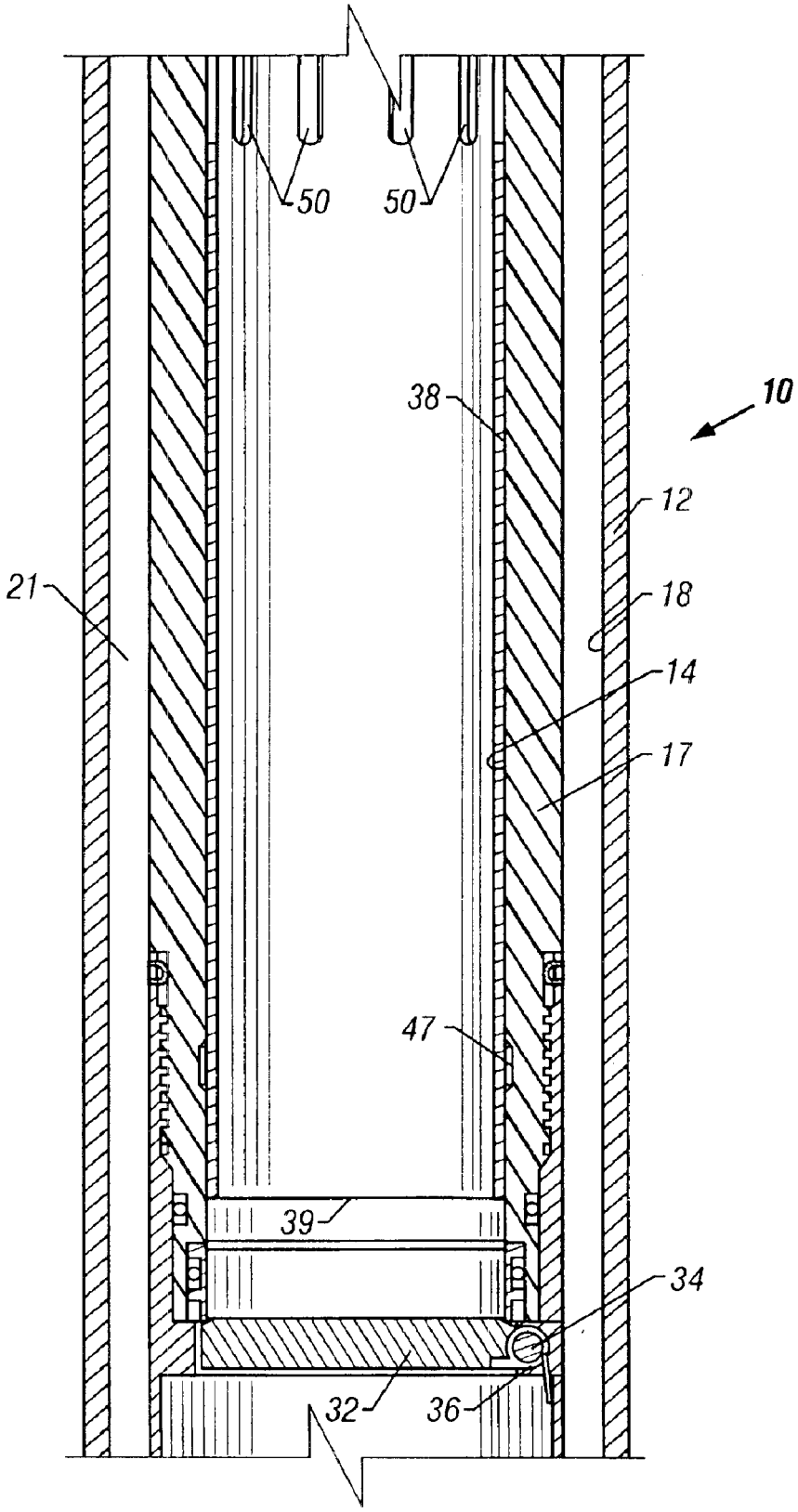

As shown in FIG. 1H, the device 10 may further include a closure member 32 disposed for movement between an open and a closed position to control fluid flow through the first bore 14. The closure member 32 is shown in its closed position. In a specific embodiment, the closure member 32 may be a flapper having an arm 34 hingedly connected to the extension member 17. The flapper 32 may be biased into its closed position by a hinge spring 36. Other types of closure members 32 are within the scope of the present invention, including, for example, a ball valve.

As shown in FIGS. 1F–1H, the device 10 may further include a second sleeve member 38 movably disposed and remotely shiftable within the first bore 14 to move the closure member 32 between its open and closed positions. As shown in FIG. 1E, the second sleeve member 38 may include an inner surface 40 having a locking profile 42 disposed therein for mating with a shifting tool (not shown). As shown in FIG. 1G, the second sleeve member 38 may also include at least one rib 44 that is shown engaged with a first annular recess 46 in the first bore 14 of the extension member 17. In a specific embodiment, the second sleeve member 38 may include a plurality of ribs 44 disposed on a plurality of collet sections 48 in the second sleeve member 38 that may be disposed between a plurality of slots 50 in the second sleeve member 38. As will be more fully discussed below, the second sleeve member 38 may be shifted downwardly to engage the ribs 44 with a second annular recess 47 in the first bore 14 of the extension member 17. The second sleeve member 38 may further include at least one first equalizing port 52 for cooperating with at least one second equalizing port 54 in the extension member 17 to equalize pressure above and below the flapper 32 prior to shifting the second sleeve member 38 downwardly to open the flapper 32. The first equalizing port 52 establishes fluid communication between the inner surface 40 of the second sleeve member 38 and the first bore 14 of the extension member 17. The second equalizing port 54 establishes fluid communication between the first bore 14 of the extension member 17 and the annular space 21. A first annular seal 56 and a second annular seal 58 may be disposed within the first bore 14 of the extension member 17 and in sealing relationship about the second sleeve member 38. The second equalizing port 54 is disposed between the first and second annular seals 56 and 58. When the ribs 44 on the second sleeve member 38 are engaged with the first annular recess 46 in the extension member 17, the first annular seal 56 is disposed between the first and second equalizing ports 52 and 54, and a distal end 39 of the second sleeve member 38 is spaced from the closure member 32.

When it is desired to open the flapper 32, to enable passage of wireline tools (not shown) to positions below the device 10, a wireline shifting tool (not shown) may be engaged with the locking profile 42 (FIG. 1G) and used to shift the second sleeve member 38 downwardly until the distal end 39 (FIG. 1H) of the second sleeve member 38 comes into contact with the flapper 32. This will align the first and second equalizing ports 52 and 54, and thereby establish fluid communication between the annular space 21 and the inner surface 40 of the second sleeve member 38. In this manner, pressure may be equalized above and below the flapper 32 prior to opening of the flapper 32. The second sleeve member 38 may then continue downwardly to push the flapper 32 open, without having to overcome upward forces imparted to the flapper 32 by pressure below the flapper 32. It is noted, with reference to FIG. 1E, that pressure above and below the flapper 32 may also be equalized prior to opening of the flapper 32 by shifting the first sleeve member 26 to separate the first and second valve seats 22 and 28 to establish fluid communication between the annular space 21 and an inner surface 27 of the first sleeve member 26.

Figure 7:
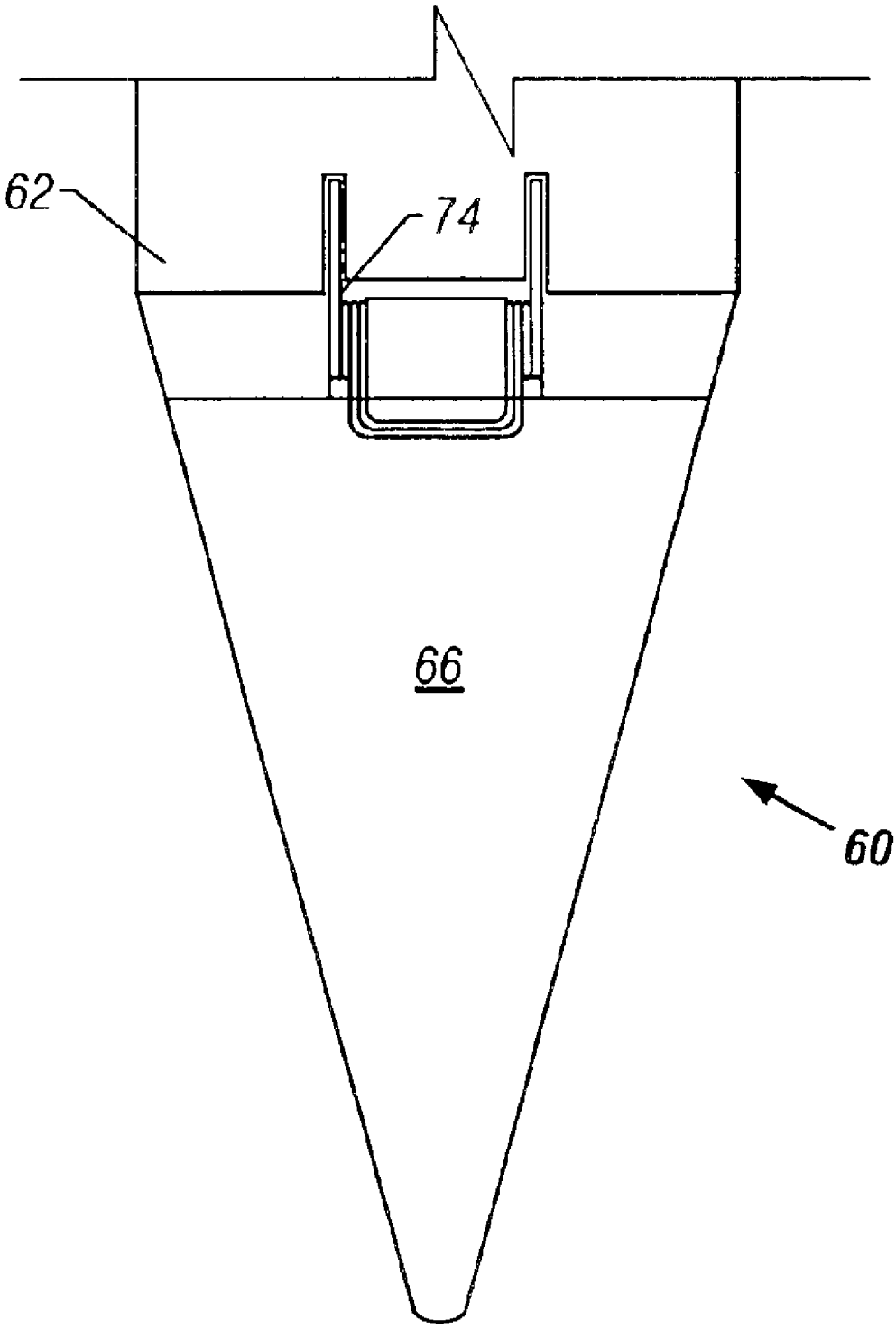
FIG. 7 is a partial elevation view taken along line 7—7 of FIG. 1I.

With reference to FIGS. 1I and 7, the device 10 may further include a cone member 60 connected to a distal end 62 of the extension member 17. In a specific embodiment, the cone member 60 may include a first and a second half-cone member 64 and 66, each of which may be hingedly attached to the distal end 62 of the extension member 17, as by a first and a second hinge pin 68 and 70, respectively, and biased towards each other, as by first and second hinge springs 72 and 74, respectively. The springs 72 and 74 bias and hold the half-cone members 64 and 66 in mating relationship, or in a normally-closed position, to form a cone, as shown in FIG. 1I. In this normally-closed position, the cone member 60 directs fluid flowing from the second end 20 of the body member 12 into the annular space 21, and functions to minimize turbulence as fluid flows into the annular space 21. In this regard, in a preferred embodiment, an angle $\alpha$ formed between a first outer surface 65 of the first half-cone member 64 and a second outer surface 67 of the second half-cone member 66 may be approximately forty-four (44) degrees when the half-cone members 64 and 66 are biased towards each other to form a cone, as shown in FIG. 1I. When it is desired to pass a wireline tool through the device 10 from the first end 16 of the body member 12 to the second end 20 of the body member, then the second sleeve member 38 (FIGS. 1F–1H) may be shifted downwardly (by locating a wireline shifting tool (not shown) in the locking profile 42, as discussed above) from its position shown in FIGS. 1F–1H to a lower position (not shown) in which the first and second half-cone members 64 and 66 are separated and their respective inner surfaces 69 and 70 are disposed about the second sleeve member 38. With reference to FIG. 1G, the ribs 44 on the second sleeve member 38 may be disposed within the second annular recess 47 in the extension member 17 when the second sleeve member 38 is in its lower position (not shown).

The manner in which the first sleeve member 26 is remotely shifted will now be described. Referring to FIGS. 1B–1D, in a specific embodiment, a piston 76 may be connected to, or a part of, the first sleeve member 26, and may be sealably, slidably disposed within the first bore 14 of the body member 12. In a specific embodiment, the piston 76 may be an annular piston or at least one rod piston. A first hydraulic conduit 78 is connected between a source of hydraulic fluid (not shown), such as at the earth's surface (not shown), and the body member 12, as at fitting 81, and is in fluid communication with a first side 80 of the piston 76, such as through a first passageway 79 in the body member 12. The first sleeve member 26 may be remotely shifted downwardly, or away from the first end 16 of the body member 12, by application of pressurized fluid to the first side 80 of the piston 76. A number of mechanisms for biasing the first sleeve member 26 upwardly, or towards the first end 16 of the body member 12, may be provided within the scope of the present invention, including but not limited to another hydraulic conduit, pressurized gas, spring force, and annulus pressure, and/or any combination thereof.

Figure 3:
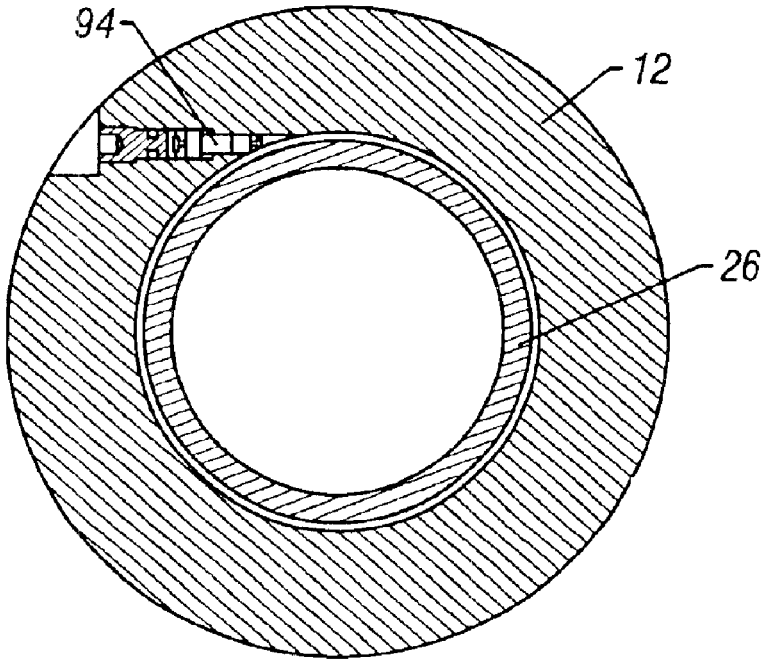
FIG. 3 is a cross-sectional view taken along line 3—3 of FIG. 1E.
Figure 4:
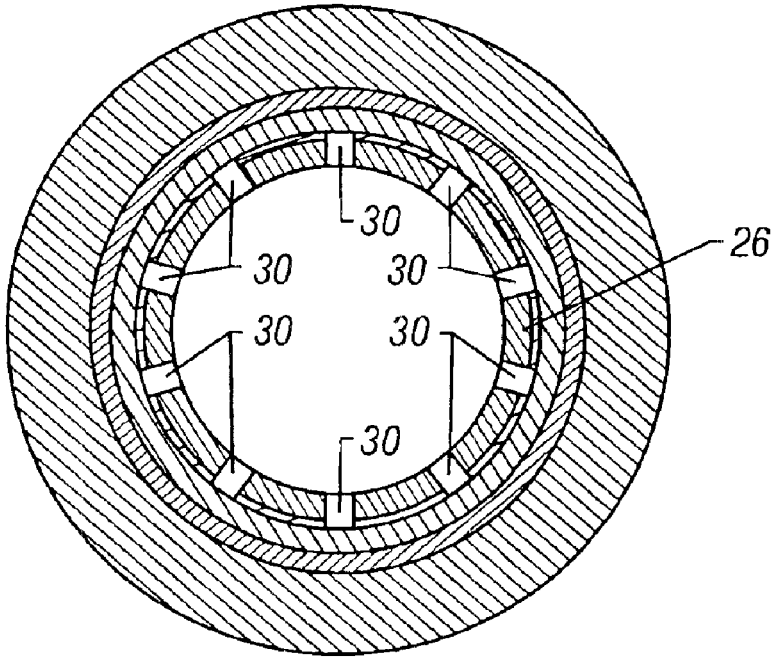
FIG. 4 is a cross-sectional view taken along line 4—4 of FIG. 1E.
Figure 5:
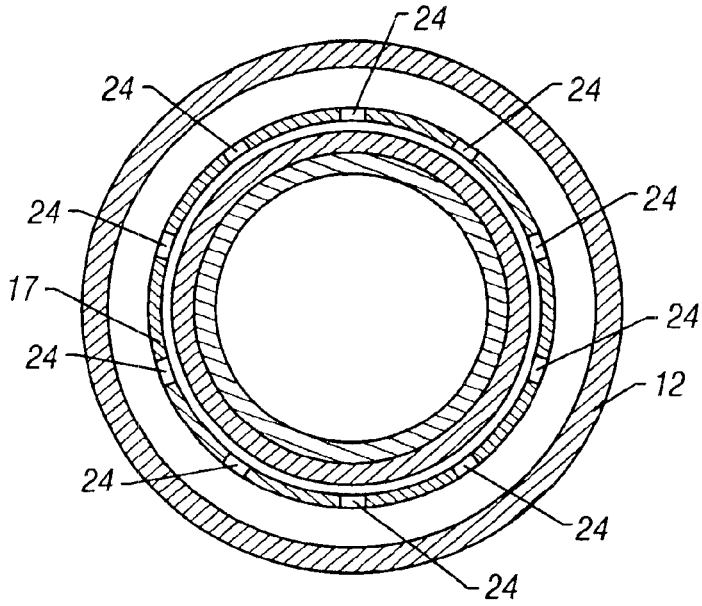
FIG. 5 is a cross-sectional view taken along line 5—5 of FIG. 1E.

In a specific embodiment, as shown in FIG. 1A, the biasing mechanism may include a source of pressurized gas, such as pressurized nitrogen, which may be contained within a sealed chamber, such as a gas conduit 82. An upper portion 84 of the gas conduit 82 may be coiled within a housing 85 formed within the body member 12, and a lower portion 86 of the gas conduit 82 (FIG. 1B) may extend outside the body member 12 and terminate at a fitting 88 connected to the body member 12. The gas conduit 82 is in fluid communication with a second side 90 of the piston 76, such as through a second passageway 92 in the body member 12. Appropriate seals are provided to contain the pressurized gas. As shown in FIG. 3, the body member 12 may include a charging port 94, which may include a dill core valve, through which pressurized gas may be introduced into the device 10.

Figure 8:
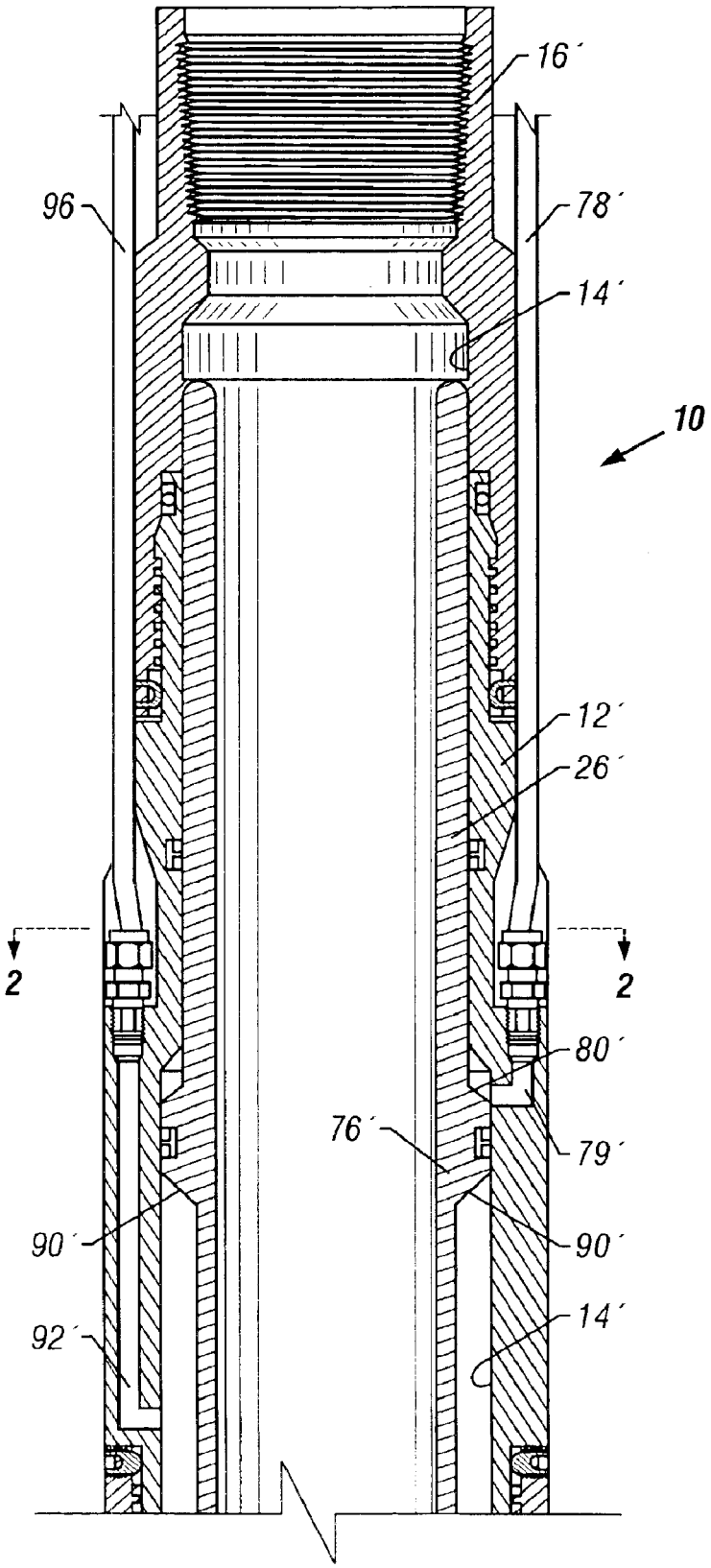
FIG. 8 is a longitudinal sectional view, similar to FIGS. 1A and 1B, showing an upper portion of another specific embodiment of the flow control device of the present invention.

Another biasing mechanism is shown in FIG. 8, which is a view similar to FIGS. 1A and 1B, and illustrates an upper portion of another specific embodiment of the present invention, which is referred to generally by the numeral 10'. The lower portion of this embodiment is the same as shown in FIGS. 1C–1I. In this embodiment, a second hydraulic conduit 96 is connected between a source of hydraulic fluid (not shown), such as at the earth's surface (not shown), and the body member 12', and is in fluid communication with the second side 90' of the piston 76', such as through the second passageway 92' in the body member 12'. As such, in this embodiment, hydraulic fluid is used instead of pressurized gas to bias the first sleeve member 26' towards the first end 16' of the body member 12'.

Figure 9:
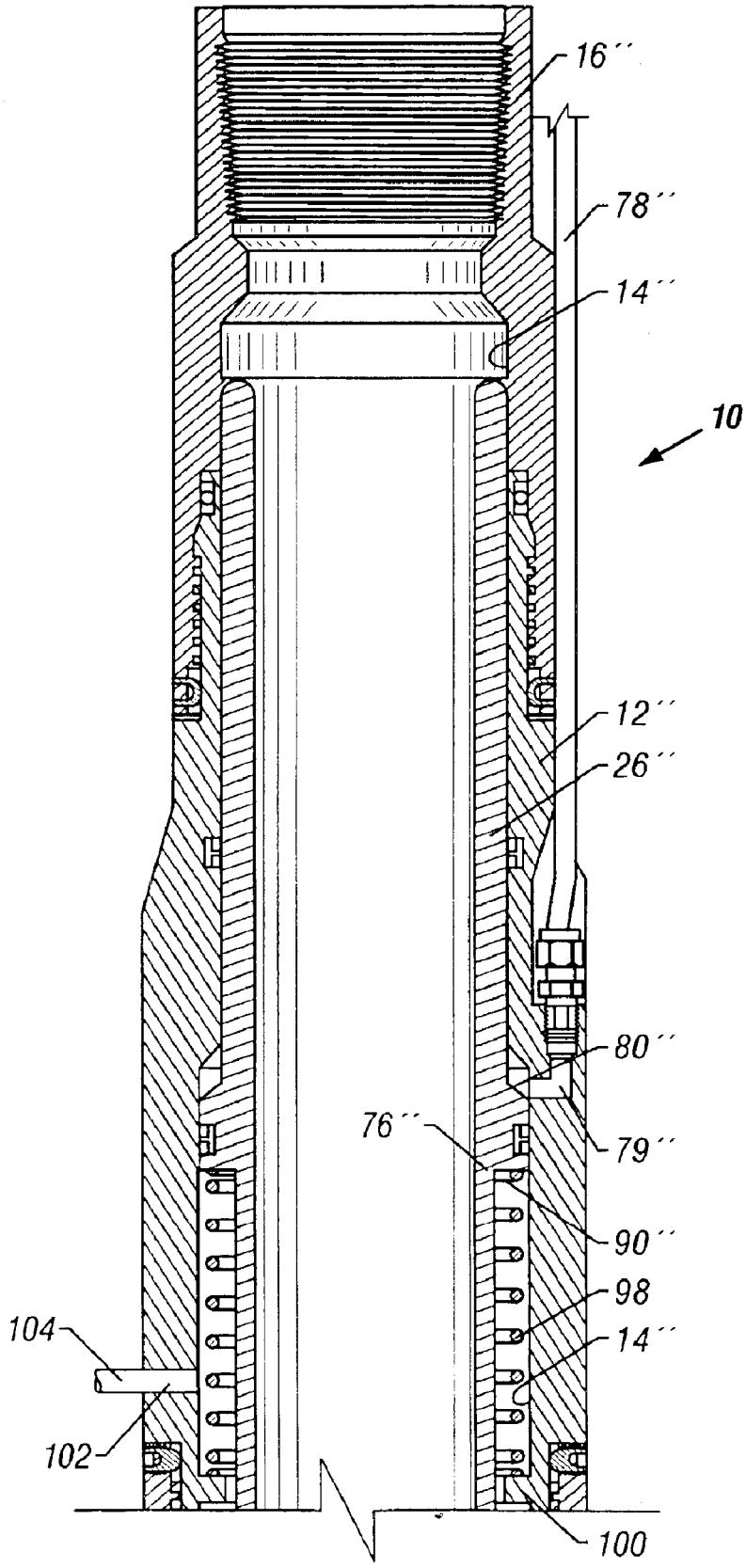
FIG. 9 is a longitudinal sectional view, similar to FIG. 8, showing an upper portion of another specific embodiment of the flow control device of the present invention.

Another biasing mechanism is shown in FIG. 9, which is a view similar to FIG. 8, and illustrates an upper portion of another specific embodiment of the present invention, which is referred to generally by the numeral 10". The lower portion of this embodiment is as shown in FIGS. 1C–1I. In this embodiment, a spring 98 is disposed within the first bore 14", about the first sleeve member 26", and between an annular shoulder 100 on the body member 12" and the second side 90" of the piston 76". As such, in this embodiment, force of the spring 98 is used instead of pressurized gas or hydraulic fluid to bias the first sleeve member 26" toward the first end 16" of the body member 12". Alternatively, as shown in FIG. 9, the device 10" may also include a port 102 in the body member 12" connected to a conduit 104 through which hydraulic fluid or pressurized gas may also be applied to the second side 90" of the piston 76" to assist the spring 98 in biasing the first sleeve member 26" toward the first end 16" of the body member 12". In this regard, if hydraulic fluid is desired, the conduit 104 may be a hydraulic conduit, such as the second hydraulic conduit 96 shown in FIG. 8. Alternatively, if pressurized gas is desired, the conduit 104 may be a gas conduit, such as the gas conduit 82 shown in FIGS. 1A–1B. In another specific embodiment, instead of using hydraulic fluid or pressurized gas, the port 102 may be in communication with annulus pressure, which may be used to bias the first sleeve member 26" toward the first end 16" of the body member 12", either by itself, or in combination with the spring 98.

Figure 6:
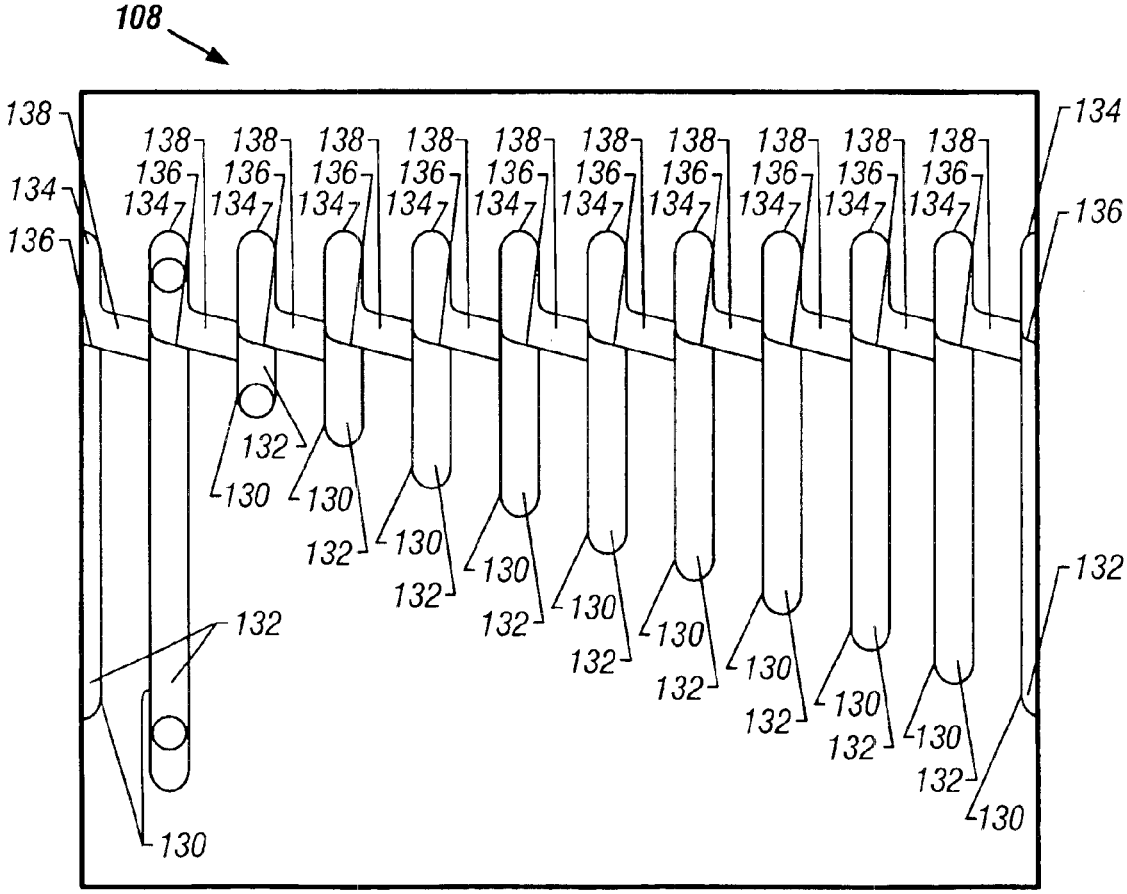
FIG. 6 illustrates a planar projection of an outer cylindrical surface of a position holder shown in FIGS. 1C and 1D.

Referring now to FIGS. 1C–1D and 6, the device 10 of the present invention may also include a position holder to enable an operator at the earth's surface (not shown) to remotely locate and maintain the first sleeve member 26 in a plurality of discrete positions, thereby providing the operator with the ability to remotely regulate fluid flow through the at least one flow port 24 in the extension member 17 (FIG. 1E), and/or through the at least one flow slot 30 in the first sleeve member 26 (FIG. 1E). The position holder may be provided in a variety of configurations. In a specific embodiment, as shown in FIGS. 1C–1D and 6, the position holder may include an indexing cylinder 106 having a recessed profile 108 (FIG. 6), and be adapted so that a retaining member 110 (FIG. 1D) may be biased into cooperable engagement with the recessed profile 108, as will be more fully explained below. In a specific embodiment, one of the position holder 106 and the retaining member 110 may be connected to the first sleeve member 26, and the other of the position holder 106 and the retaining member 110 may be connected to the body member 12. In a specific embodiment, the recessed profile 108 may be formed in the first sleeve member 26, or it may be formed in the indexing cylinder 106 disposed about the first sleeve member 26. In this embodiment, the indexing cylinder 106 and the first sleeve member 26 are fixed to each other so as to prevent longitudinal movement relative to each other. As to relative rotatable movement between the two, however, the indexing cylinder 106 and the first sleeve member 26 may be fixed so as to prevent relative rotatable movement between the two, or the indexing cylinder 106 may be slidably disposed about the first sleeve member 26 so as to permit relative rotatable movement. In the specific embodiment shown in FIGS. 1C–1D, in which the recessed profile 108 is formed in the indexing cylinder 106, the indexing cylinder 106 is disposed for rotatable movement relative to the first sleeve member 26, as per roller bearings 112 and 114, and ball bearings 116 and 118.

In a specific embodiment, with reference to FIGS. 1C–1D, the retaining member 110 may include an elongate body 120 having a cam finger 122 at a distal end thereof and a hinge bore 124 at a proximal end thereof. A hinge pin 126 is disposed within the hinge bore 124 and connected to the body member 12. In this manner, the retaining member 110 may be hingedly connected to the body member 12. A biasing member 128, such as a spring, may be provided to bias the retaining member 110 into engagement with the recessed profile 108. Other embodiments of the retaining member 110 are within the scope of the present invention. For example, the retaining member 110 may be a spring-loaded detent pin (not shown).

The recessed profile 108 will now be described with reference to FIG. 6, which illustrates a planar projection of the recessed profile 108 in the indexing cylinder 106. As shown in FIG. 6, the recessed profile 108 preferably includes a plurality of axial slots 130 of varying length disposed circumferentially around the indexing cylinder 106, in substantially parallel relationship, each of which are adapted to selectively receive the cam finger 122 on the retaining member 110. While the specific embodiment shown includes twelve axial slots 130, this number should not be taken as a limitation. Rather, it should be understood that the present invention encompasses a recessed profile 108 having any number of axial slots 130. Each axial slot 130 includes a lower portion 132 and an upper portion 134. The upper portion 134 is recessed, or deeper, relative to the lower portion 132, and an inclined shoulder 136 separates the lower and upper portions 132 and 134. An upwardly ramped slot 138 leads from the upper portion 134 of each axial slot 130 to the elevated lower portion 132 of an immediately neighboring axial slot 130, with the inclined shoulder 136 defining the lower wall of each upwardly ramped slot 138.

In operation, the first sleeve member 26 is normally biased upwardly, so that the cam finger 122 of the retaining member 110 is positioned against the bottom of the lower portion 132 of one of the axial slots 130. When it is desired to change the position of the first sleeve member 26, hydraulic pressure should be applied from the first hydraulic conduit 78 (FIG. 1B) to the first side 80 of the piston 76 for a period long enough to shift the cam finger 122 into engagement with the recessed upper portion 134 of the axial slot 130. Hydraulic pressure should then be removed so that the first sleeve member 26 is biased upwardly, thereby causing the cam finger 122 to engage the inclined shoulder 136 and move up the upwardly ramped slot 138 and into the lower portion 132 of the immediately neighboring axial slot 130 having a different length. It is noted that, in the specific embodiment shown, the indexing cylinder 106 will rotate relative to the retaining member 110, which is hingedly secured to the body member 12. By applying and removing pressurized fluid from the first side 80 of the piston 76, the cam finger 122 may be moved into the axial slot 130 having the desired length corresponding to the desired position of the first sleeve member 26. This enables an operator at the earth's surface to shift the first sleeve member 26 into a plurality of discrete positions and control the distance between the first and second valve seats 22 and 28 (FIG. 1E), and thereby regulate fluid flow through the at least one flow port 24 and/or the at least one flow slot 30.

Figure 10:
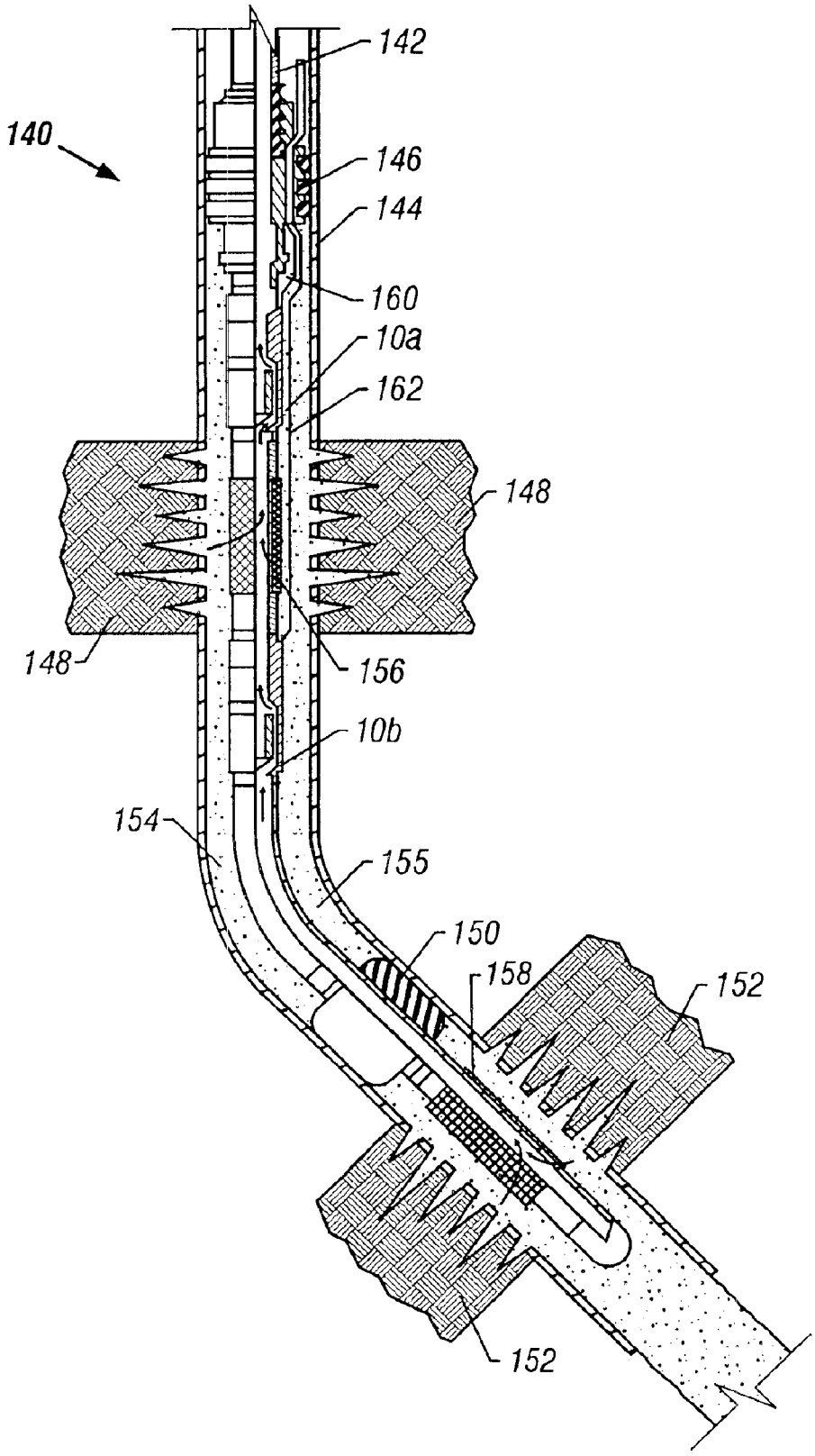
FIG. 10 is a schematic representation of a specific embodiment of a well completion in which the flow control device of the present invention may be used.
Figure 11:
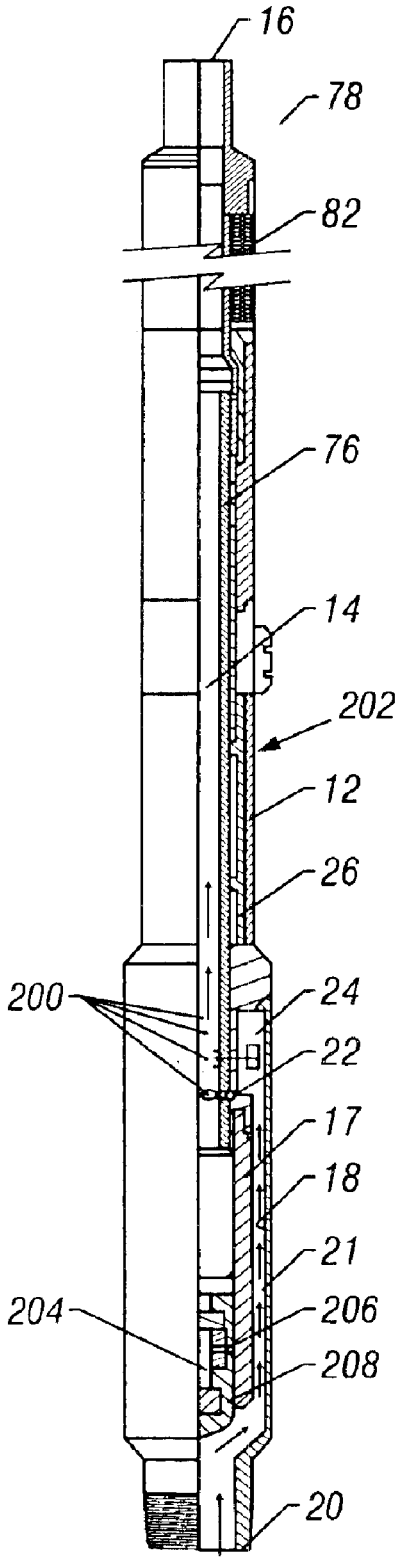

Methods of using the flow control device 10 of the present invention will be now be explained in connection with a specific embodiment of a well completion denoted generally by the numeral 140, as illustrated in FIG. 10. Referring now to FIG. 10, the well completion 140 may include a production tubing 142 extending from the earth's surface (not shown) and disposed within a well casing 144, with a first packer 146 connected to the tubing 142 and disposed above a first hydrocarbon formation 148, and a second packer 150 connected to the tubing 142 and disposed between the first hydrocarbon formation 148 and a second hydrocarbon formation 152. A well annulus 154 may be packed with gravel 155. A first sand screen 156 may be connected to the tubing 142 adjacent the first formation 148, and a second sand screen 158 may be connected to the tubing 142 adjacent the second formation 152. A first flow control device 10*a* of the present invention may be connected to the tubing 142 and disposed between the first packer 146 and the first formation 148, and a second flow control device 10*b* of the present invention may be connected to the tubing 142 and disposed between the first formation 148 and the second packer 150. A first hydraulic conduit 160 may be connected from a source of pressurized fluid (not shown), such as at the earth's surface (not shown), to the first flow control device 10*a*, and a second hydraulic conduit 162 may be connected from a source of pressurized fluid (not shown), such as at the earth's surface (not shown), to the second flow control device 10*b*.

In a specific embodiment, the pressure within the first formation 148 may be greater than the pressure within the second formation 152. In this case, it may be desirable to restrict fluid communication between the first and second formations 148 and 152, otherwise hydrocarbons from the first formation 148 would flow into the second formation 152 instead of to the earth's surface. To this end, the first sleeve member 26 (FIGS. 1A–1G) within the second flow control device 10*b* may be remotely shifted upwardly to bring the first and second valve seats 22 and 28 into sealing contact, thereby preventing fluid communication between the first and second formations 148 and 152. The first sleeve member 26 in the first flow control device 10*a* may be remotely shifted to regulate fluid flow from the first formation 148 to the earth's surface. The first and second flow control devices 10*a* and 10*b* may be remotely manipulated as required depending upon which formation is to be produced, and/or whether wireline intervention techniques are to be performed.

The flow control device 10 of the present invention may be used to produce hydrocarbons from a formation, such as formation 148 or 152, to the earth's surface, or to inject chemicals from the earth's surface (not shown) into the well annulus 154, and/or into a hydrocarbon formation, such as formation 148 or 152. If the device 10 is to be used for producing fluids, then the device 10 should be positioned with the first end 16 of the device 10 (FIG. 1A) above the second end 20 of the device 10 (FIG. 1I). But if the device 10 is to be used to inject chemicals, then the device 10 should be positioned "upside down" so that the second end 20 is above the first end 16.

Figure 11:
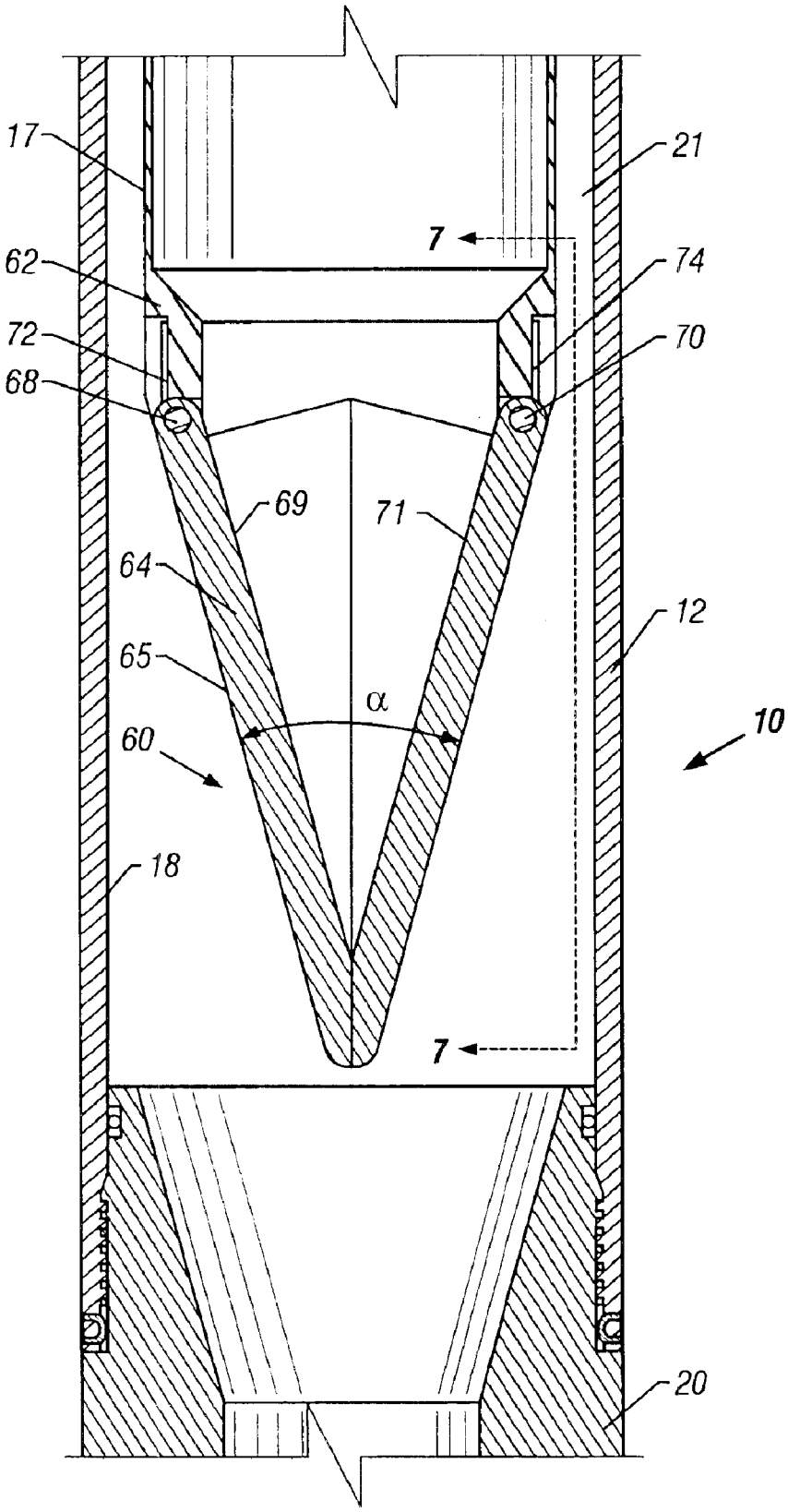
FIG. 11 is a partial cross sectional view of an alternative embodiment of the present invention.
Figure 1J:
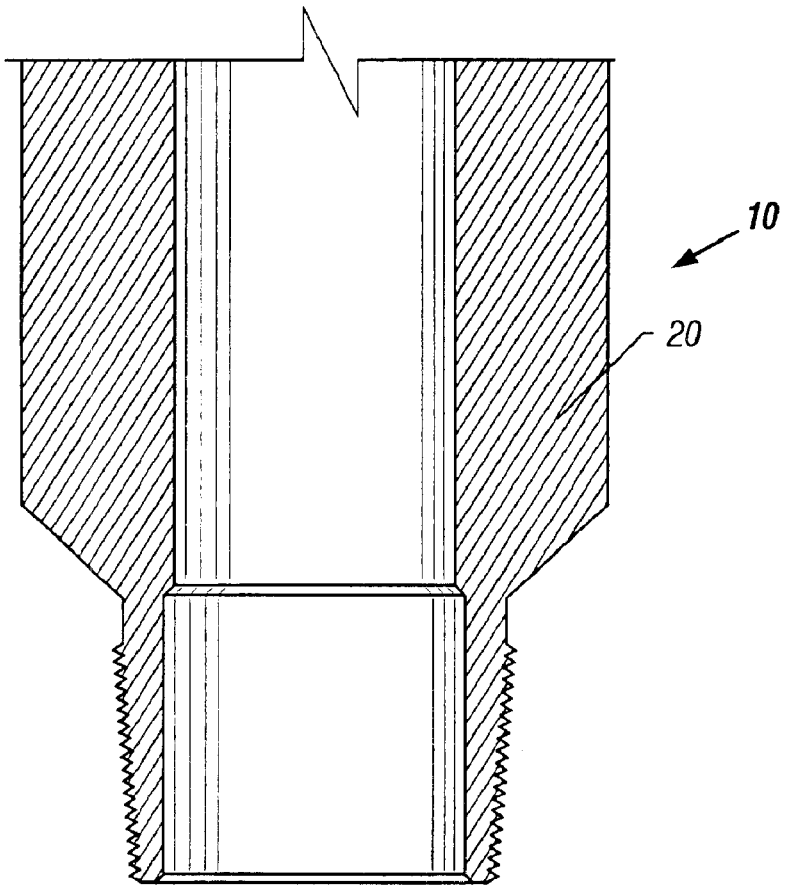
Figure 2:
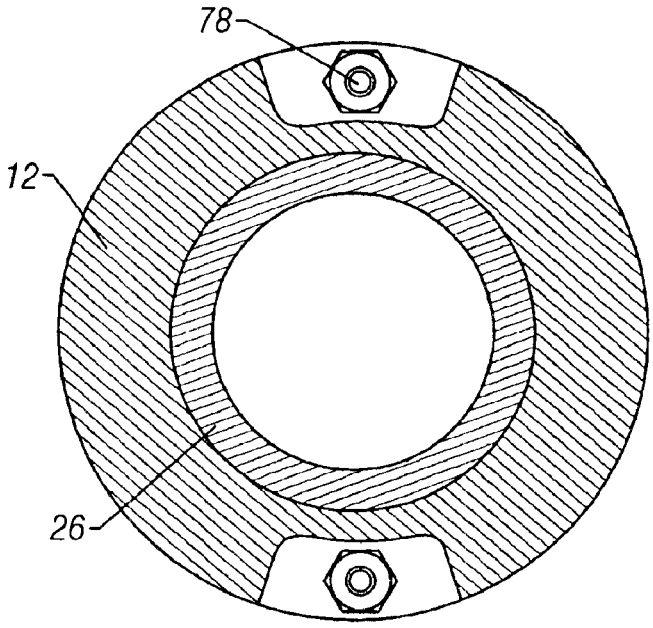
FIG. 2 is a cross-sectional view taken along line 2—2 of FIG. 1B.

FIG. 11 discloses an alternative embodiment of the present invention. As shown in the figure, the device 10 has a body 12 defining a first bore 14 therethrough. A second bore 18 in the annular space 21 of the body 12 provides an alternate pathway through the body 12. As in the previously described embodiment, flow through the second bore 18, which may be annular or one or more discrete passageways in the annular space 21, is controlled by a sleeve valve. The sleeve valve comprises a sleeve member 26 having a plurality of sleeve ports 200 therein (the sleeve ports may be replaced by the flow slots 30 of the previous embodiments or other similar openings). However, in the embodiment shown in FIG. 11, the sleeve ports 200 comprise a plurality of discrete holes through the sleeve member 26. The sleeve ports 200 have a size selected to produce a specific flow area when opened to the flow port(s) 24 between the first bore 14 and the second bore(s) 18. For example, FIG. 11 shows the sleeve member 26 in the fully open position in which all of the sleeve ports are positioned above the valve seat 22 in fluid communication with the flow port 24. In this position, the flow may be, in one example, full bore flow in which the flow area through the sleeve ports 200 is approximately at least as great as the flow area of the first bore 14 or the second bore 18. The sleeve ports 200 are spaced longitudinally so that sleeve member may be positioned with the valve seat 22 between sets of sleeve ports 200 to define different preselected flow areas through the sleeve member. The position holder or indexing mechanism shown generally at 202 defines the discrete positions of the sleeve member 26. The indexing mechanism may be the indexing sleeve described previously, another j-slot type indexer, or some other type of known indexer. Applying and removing pressure to the sleeve member 26 via the control line (or hydraulic conduit) 78 provides for selective positioning of the sleeve member 26. As mentioned previously, the sleeve member 26 generally has a biasing member such as a pressurized balance gas in a gas conduit 82 to bias the sleeve member 26 in a give direction to facilitate operation.

The embodiment describe of the present invention described in connection with FIG. 1 for example generally describes the present invention as including a flapper valve in the first bore 14, although the description clearly states that other closure members 32 may be used (such as ball valves). The embodiment shown in FIG. 11 discloses a removable plug 204 as the closure member 32. In general, the plug includes a locating and positioning locator 206 (such as a profile and lock) to accurately position the plug in the well, and specifically the body 12. The plug includes a seal 208 that abuts the first bore 14 which may include a polished bore receptacle to essentially block flow through the first bore 14. Note however that when the present description refers to closing a valve or blocking flow, some leakage or planned flow through the valve may be acceptable. Thus, in the present description, "closed" or "blocked" allows for some flow such as five or ten percent flow. The plug 204 is position between the inlet to the second bore 18 and the flow ports 18 so that, when the plug is in place, the fluid is routed through the second bore 18 and the flow ports 24. In this way, the fluid through the device 10 is regulated by the sleeve member 26 which may be, for example, controlled from the surface or a downhole controller. The plug 204 may be retrieved from the device 10 by a retrieving tool (not shown) which may be run into the well on a standard carrier line (e.g., wireline, slickline, coiled tubing). To facilitate positioning and retrieval, the plug may use locking dogs, one or more collets, or other known positioning devices.

Figure 12:
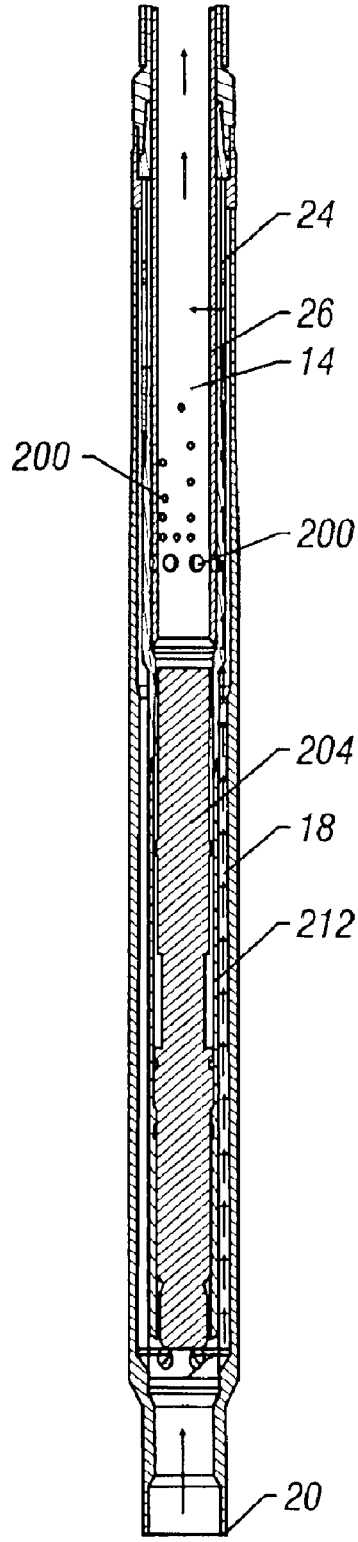
FIG. 12 is a partial cross sectional view of an alternative embodiment of the present invention.

FIG. 12 shows the sleeve member 26 in the closed position with the flow ports 24 below the valve seat 22. The selective plug 204 is positioned in the device 10 in the nipple 212 having a selective profile as shown as the locator 206.

Note that the first bore 14 generally provides access through the device (or valve) 10 when the closure member 32 is open or removed and may therefore be referred to as the access bore or passageway. Thereby, tools may be passed through the device 10 to, for example, re-enter the well. As an example, a wireline, slickline, or coiled tubing deployed tool could be run through the device 10 when the first bore 13 is open. Likewise, the second bore provides for fluid flow when the first bore 14 is closed and may therefore be referred to as a bypass or bypass flowpath or passageway.

Although described generally as a hydraulically controlled valve, the device could also be controlled electrically by replacing the hydraulic components with motors or solenoids or the like and electrical communication lines.

It is to be understood that the invention is not limited to the exact details of construction, operation, exact materials or embodiments shown and described, as obvious modifications and equivalents will be apparent to one skilled in the art. For example, while the device 10 has been described as being remotely controlled via at least one hydraulic conduit (e.g., conduit 78 in FIG. 1A), the device 10 could just as easily be remotely controlled via an electrical conductor and still be within the scope of the present invention. Additionally, while the device 10 of the present invention has been described for use in well completions which include gravel pack in the well annulus, the device 10 may also be used in well completions lacking gravel pack and still be within the scope of the present invention.

Accordingly, the invention is therefore to be limited only by the scope of the appended claims.

What is claimed is:

1. A downhole flow control device, comprising:

a body defining a first passageway and a second passageway;

a closure member coupled to the body and movable to selectively, substantially prevent flow through the first passageway; and a sleeve valve in the body selectively positionable at an open position, a closed position and a plurality of predetermined positions therebetween, the sleeve valve being adapted to regulate the flow through the second passageway, wherein the open position enables full bore flow.

2. The device of claim 1, wherein the closure member is a plug.

3. A downhole flow control device, comprising:

a body defining a first passageway and a second passageway;

a closure member movable to selectively, substantially prevent flow through the first passageway; and a sleeve valve in the body selectively positionable at and between an open position and a closed position adapted to regulate the flow through the second passageway, wherein the closure member is a flapper valve.

4. The device of claim 3, wherein the flapper valve is controlled from the surface via a control line.

5. A downhole flow control device, comprising:

a conduit having a first bore therethrough;

the conduit further defining at least one second bore radially surrounding the first bore, the first bore and the at least one second bore being oriented in an axial direction;

a sleeve member in the conduit selectively movable at predetermined increments between an open position and a closed position to choke the flow through the second bore; and a flapper movable between opened and closed positions to control flow in the first bore.

6. The device of claim 5, wherein the sleeve member defines a plurality of sleeve ports therethrough, the sleeve ports selected to provide a predetermined flow area depending upon the position of the sleeve member.

7. The device of claim 5, wherein the second bore has opposing ends in fluid communication with the first bore.

8. The device of claim 7, further comprising a closure member adapted to control the flow through the first bore, the closure member positioned between the opposing ends of the second bore.

* * * * *